US010443252B2

(12) United States Patent
Lu

(10) Patent No.: US 10,443,252 B2
(45) Date of Patent: Oct. 15, 2019

(54) REBAR TYING MACHINE

(71) Applicant: (TAIZHOU XINDALU ELECTRONIC TECHNOLOGY CO., LTD.), Zhejiang (CN)

(72) Inventor: Fujun Lu, Zhejiang (CN)

(73) Assignee: Taizhou Xingdalu Electronic Technology Co., Ltd., Taizhou, Zhejiang (CN)

( * ) Notice: Subject to any disclaimer, the term of this patent is extended or adjusted under 35 U.S.C. 154(b) by 685 days.

(21) Appl. No.: 14/893,026

(22) PCT Filed: Nov. 18, 2013

(86) PCT No.: PCT/CN2013/001410
§ 371 (c)(1),
(2) Date: Nov. 20, 2015

(87) PCT Pub. No.: WO2014/186927
PCT Pub. Date: Nov. 27, 2014

(65) Prior Publication Data

US 2016/0108632 A1 Apr. 21, 2016

(30) Foreign Application Priority Data

May 23, 2013 (CN) ..... 2013 2 0291470 U

(51) Int. Cl.
*E04G 21/12* (2006.01)
*B65B 13/02* (2006.01)
(Continued)

(52) U.S. Cl.
CPC ..... *E04G 21/123* (2013.01); *B65B 13/04* (2013.01); *B65B 13/06* (2013.01); *B65B 13/187* (2013.01);
(Continued)

(58) Field of Classification Search
CPC ..... E04G 21/123; E04G 21/122; B65B 13/04; B65B 13/06; B65B 13/187; B65B 13/285;
(Continued)

(56) References Cited

U.S. PATENT DOCUMENTS 5,871,036 A * 2/1999 Murayama ..... E04G 21/123 140/119
8,051,880 B2 * 11/2011 Nagaoka ..... E04G 21/122 140/57
2005/0005992 A1 * 1/2005 Kusakari ..... B21F 15/06 140/119

FOREIGN PATENT DOCUMENTS

JP 10-250703 * 9/1998

OTHER PUBLICATIONS

Machine translation of JP 10-250703 to Toyoda et al.*

* cited by examiner

*Primary Examiner* — Gregory D Swiatocha
(74) *Attorney, Agent, or Firm* — Jen-Feng Lee, Esq.

(57) ABSTRACT

A rebar tying machine comprising a tying machine main body (1) and a steel wire winding assembly (2) mounted in the main body, a steel wire cutting off mechanism (3) is further mounted in the main body and comprises a transmission device (31) and a wire discharging block (32), the steel wire winding assembly comprises a winding mechanism (21), a driving device (22) for driving the winding mechanism and a locking device for locking the winding mechanism, an advance/retreat locating slot (211) and a rotating cam slot which are communicated with each other are arranged on the winding mechanism, an anti-rotation fixing pin (231) in the locking device moves axially in the advance/retreat locating slot, and the anti-rotation fixed pin slides in the rotating cam slot along the circumferential direction. The rebar tying machine has the advantageous
(Continued)

effect that: the anti-rotation fixed pin moves axially in the advance/retreat locating slot and slides in the rotating cam slot along the circumferential direction, and the sidewall of the rotating cam slot extends along the axial direction of a sleeve (216) to form a chamfer structure, thus preventing the tying machine from locking and further ensuring the working smoothness of the winding mechanism.

9 Claims, 15 Drawing Sheets

(51) Int. Cl.

| | |
|---|---|
| ***B65B 13/04*** | (2006.01) |
| ***B65B 13/06*** | (2006.01) |
| ***B65B 13/18*** | (2006.01) |
| ***B65B 13/28*** | (2006.01) |
| ***B65B 27/10*** | (2006.01) |

(52) U.S. Cl.
CPC ..... *B65B 13/285* (2013.01); *B65B 13/025* (2013.01); *B65B 13/185* (2013.01); *B65B 27/10* (2013.01)

(58) Field of Classification Search
CPC ..... B65B 13/28; B65B 27/10; B65B 13/025; B65B 13/185; B65B 13/24; B21F 7/00; B21F 15/04; B23B 31/113; Y10T 279/17897; Y10T 279/17888; Y10T 279/17863
See application file for complete search history.

REBAR TYING MACHINE

CLAIM OF PCT APPLICATION, 35 U.S.C. § 371

The present invention is a national stage entry from a PCT application, pursuant to the provision of 35 U.S.C. section 371 et seq., based upon the application filed by the same inventor in China, having PCT application number PCT/CN2013/001410 filed on Nov. 18, 2013.

FIELD AND BACKGROUND OF THE INVENTION

A rebar tying machine includes: a tying thread feeding mechanism, configured to feed a tying thread for a steel wire reeled on a steel wire reel and wind the tying thread on the rebar; and a tying thread twisting mechanism, configured to twist the tying thread wound on the rebar. The tying thread feeding mechanism and the tying thread twisting mechanism work in sequence through the operation of a starter, in order to complete a series of tying actions. For example, Chinese Invention Patent 200910203087.1, publicized on Nov. 25, 2009 under CN101586399, disclosed a rebar tying machine, including: a main sleeve having a hook pivotally mounted at its leading end, a leading end shaft nested inside the main sleeve, a spiral threaded groove formed at the leading end shaft, a nested opening passing through the main sleeve from outside to inside, a tab which is nested in the nested opening and clamped into the threaded groove, a short sleeve which is disposed on the periphery of the main sleeve and covers the tab, and a clamping unit which is formed on the short sleeve and controls the rotation of the main sleeve. The rebar tying machine with such a structure has relatively low stability during operation and is easily jammed after dirt enters the mechanism.

SUMMARY OF THE INVENTION

The technical problem to be solved by the present invention is to provide a rebar tying machine which has accurate positioning, high safety factor and long service life and can effectively avoid the generation of jamming, in order to overcome shortcomings of the prior art.

A main technical solution of the present invention is that a rebar tying machine is provided, including a tying machine main body and a steel wire winding assembly mounted within the main body; the steel wire winding assembly includes a winding mechanism and a driving device for driving the winding mechanism, and further includes a locking device. An advance/retreat locating slot and a rotating cam slot, which are communicated to each other, are disposed on the winding mechanism. An anti-rotation fixing pin of the locking device axially moves in the advance/retreat locating slot, and slides in a peripheral direction in the rotating cam slot. A steel wire cutting-off mechanism, to which a wire cutting plate in the steel wire winding assembly is connected, is further mounted within the main body.

The rebar tying machine of the present invention can further have the following additional technical features.

The advance/retreat locating slot is axially disposed along the winding mechanism; and the rotating cam slot is gradually shallower in the peripheral direction and is disposed along the periphery of the winding mechanism, and the axial extension of a side wall of the rotating cam slot along a sleeve forms a chamfer structure.

The winding mechanism includes an inner core, a winding guide head mounted on the inner core, and a lead screw for driving the inner core. The inner core and the lead screw are mounted within a sleeve, and the advance/retreat locating slot and the rotating cam slot are disposed on the sleeve. A fixing sheath is disposed on the sleeve. A threaded block connected to the sleeve through the fixing sheath is mounted on the lead screw; and the winding mechanism further includes a wire cutting plate mounted on the sleeve through the fixing sheath.

The locking device further includes a fixing base and a connecting plate mounted on the fixing base. The anti-rotation fixing pin is mounted on the connecting plate, and a fixing shaft with a resetting spring is disposed on the fixing base; and the connecting plate is mounted on the fixing shaft.

The driving device includes a drive motor and a transmission gear set connected to the drive motor, the transmission gear set being connected to the lead screw.

The steel wire cutting-off mechanism includes a transmission device, a wire discharging block and a linear cutting-off device. The transmission device is connected to the linear cutting-off device; the wire discharging block has a wire discharging passage, and is further provided with a chute intersected with the wire discharging passage; and a wire cutter in the linear cutting-off device linearly slides in the chute.

The locking device further includes a pedestal having thereon a hollow protrusion in which the anti-rotation fixing pin is disposed. A resetting spring is provided between the anti-rotation fixing pin and the protrusion; and a reinforcing rib is formed between the pedestal and the protrusion.

The linear cutting-off device includes an oscillator connected to the wire cutter, a driving leg of the oscillator is connected to the transmission device, and a linkage leg of the oscillator is connected to the wire cutter through a connecting sheet. The transmission device includes a large fork and a small fork connected to each other through a connecting pin, and a lower drive plate connected to the large fork. The small fork is connected to the oscillator through a connecting rod.

A guide portion, the leading end of which bends into a circular arc, is disposed at the leading end of the main body, the oscillator is rotationally mounted on the guide portion through a bushing, and the wire discharging block is mounted at the leading end of the guide portion. A waist-shaped hole is formed on the guide portion, and the driving leg can slide within the waist-shaped hole to be connected to the connecting rod. A wire guide block is disposed on the guide portion, and a wire guide post by which the steel wires are led into the wire discharging block is disposed on the wire guide block. The large fork and the small fork are rotationally mounted on the guide portion, with triggers being disposed on the large fork and the small fork and supported against the wire cutting plate.

An elastic wire guide piece is mounted within the wire discharging passage of the guide portion, both two ends of the elastic wire guide piece are bent to form a fixing piece by which the elastic wire guide piece is mounted on the guide portion, and a downward-bent leading portion fitted with the wire discharging passage is formed on the elastic wire guide piece.

A steel wire reel and a wire wheel brake mechanism for restricting the rotation of the steel wire reel can be rotationally mounted on the main body. A power transmission device for driving the wire wheel brake mechanism is mounted on the guide portion, and connected to the wire cutting plate; the power transmission device includes a brake plate and a linkage plate connected to the brake plate through a lower connecting rod, the linkage plate being connected to the wire wheel brake mechanism, the brake plate being resisted against the wire cutting plate. The wire wheel brake mechanism includes a brake shaft, as well as a brake piece and a brake rocker arm which are both rotationally mounted on the brake shaft, the brake piece being connected to the steel wire reel. Locking grooves are evenly disposed on the steel wire reel; and a bent brake block is formed on the brake piece and clamped within the locking grooves.

An accommodating cavity for accommodating the steel wire reel is disposed on the main body; and a cover plate is rotationally mounted at a position on the tying machine main body where the accommodating cavity is located. A rotary locking device is mounted on the cover plate, and the steel wire reel is mounted within the accommodating cavity by the cover plate through the rotating lock device.

The rotating lock device includes a cover plate chuck mounted on the main body, and a rotary knob rotationally mounted on the cover plate, the rotary knob being clamped on the cover plate chuck. A clamping slot is formed on the cover plate chuck. A clamp leg and a push bar are disposed on the rotary knob. The steel wire reel is mounted within the accommodating cavity by clamping the clamp leg into the clamping slot; and a transition bevel is formed at the leading end of the cover plate chuck. The clamp leg is clamped into the clamping slot through the transition bevel, and the push bar is connected to the clamp leg through a connecting block.

The rebar tying machine provided by the present invention has the beneficial effects as follows.

First, since the anti-rotation fixing pin axially moves in the advance/retreat locating slot and slides in the peripheral direction in the rotating cam slot, the positioning of the steel wire winding assembly is more accurate, and the safety factor of the overall operation is improved by the advance/retreat locating slot and the rotating cam slot; since the axial extension of a side wall of the rotating cam slot along a sleeve forms a chamfer structure, the rebar tying machine is prevented from being jammed, the smooth operation of the winding mechanism is ensured, the wear to the parts is reduced, and the service life is prolonged.

Second, in the present invention, as the driving force arms of the large fork and the small fork are increased, it is easier to cut the steel wires off, thereby effectively reducing load of the drive motor and saving power to complete more work under the same battery. In the present invention, since triggers are designed on the large fork and the small fork and against the wire discharge plate, the wire discharge plate has two bearing points which are stressed at the same time, and the whole mechanism is thus stressed more evenly and stably. Since the chute intersected with the wire discharging passage is disposed on the wire discharging block, the wire cutter can linearly slide in the chute to cut the steel wires off. By the linear motion mechanism, the rebar tying machine may be, with low requirements on machining, easily mounted and have low production cost.

Third, since the rotating lock device is mounted on the tying machine main body, not only the steel wire reel may be mounted on the tying machine main body, but also the cover plate mounted on the tying machine main body may be completely opened, without interfering the mounting and demounting of the wire wheel so that the steel wire reel may be demounted and mounted conveniently. As the cover plate closing, the operation of turning the rotary knob is not required, so that some action may be omitted during the operation.

Fourth, with the mechanical connecting rod linkage, the brake and release of the wire wheel are determined by advance/retreat positions of the winding assembly, so that the rebar tying machine has simple structure and convenient manufacture and installation, and is free of restrictions from external conditions and environmental factors. The brake of the wire wheel is completely realized by the elasticity of a torsion spring, without requiring any power supplies or any electrical control circuits and components, thereby saving power and reducing the cost.

DETAILED DESCRIPTION OF PREFERRED EMBODIMENT

Figure 1:
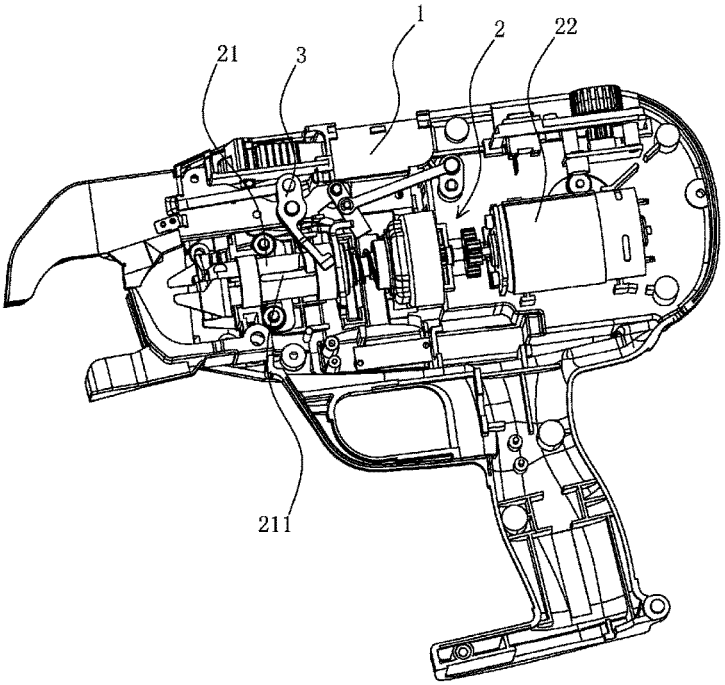
FIG. 1 is an internal structure diagram of a rebar tying machine according to the present invention.

The present invention will be further described in detail with reference to the accompanying drawings.

As illustrated in FIG. 1 to FIG. 19, the present invention provides embodiments of a rebar tying machine, including a tying machine main body 1 and a steel wire winding assembly 2 mounted within the tying machine main body 1. The steel wire winding assembly 2 includes a winding mechanism 21 and a driving device 22 for driving the winding mechanism 21, and a locking device 23 for locking the winding mechanism 21. An advance/retreat locating slot 211 and a rotating cam slot 212, which are communicated to each other, are disposed on the winding mechanism 21. An anti-rotation fixing pin 231 of the locking device 23 axially moves in the advance/retreat locating slot 211, and slides in a peripheral direction in the rotating cam slot 212. A steel wire cutting-off mechanism 3, to which a wire cutting plate 24 in the steel wire winding assembly 2 is connected, is further mounted within the main body 1. When in operation, the winding mechanism 21 internally starts to rotate under the drive of the driving device 22. Meanwhile, the anti-rotation fixing pin 231 in the locking device 23 is located in the advance/retreat locating slot 211, and the winding mechanism 21 can just advance or retreat instead of rotating; and after the winding mechanism 21 is advanced for a certain distance, the anti-rotation fixing pin 231 will slip out from the winding mechanism 21 into the rotating cam slot 212, and can slide in a peripheral direction in the rotating cam slot 212, and at this moment the winding mechanism 21 may rotate. With such a structure, the positioning of the steel wire winding assembly 2 is much more accurate, and the safety factor of the overall work is improved by the advance/retreat locating slot 211 and the rotating cam slot 212.

With reference to FIG. 1 to FIG. 19, according to the rebar tying machine of the present invention, two advance/retreat locating slots 211 and two rotating cam slots 212 are disposed symmetrically, thereby substantially ensuring that the anti-rotation fixing pin 231 can enter the locating slot when the winding mechanism 21 rotates for half cycle at most and that the sleeve carries out a linear retreat movement, saving the return time, shortening the duration of one working cycle and improving the operating efficiency.

With reference to FIG. 1 to FIG. 6, according to the rebar tying machine of the present invention, the advance/retreat locating slot 211 is axially disposed along the winding mechanism 21, and the rotating cam slot 212 is peripherally disposed along the winding mechanism 21. Such a structure ensures that the anti-rotation fixing pin 231 in the locking device 23 can accurately move in the axial direction and the peripheral direction of the winding mechanism 21, and that the winding mechanism 21 operates stably and accurately. The rotating cam slot 212 is gradually shallower in the peripheral direction, and the axial extension of a side wall of the rotating cam slot 212 along a sleeve 216 forms a chamfer structure by which the anti-rotation fixing pin 231 is prevented from being jammed in the rotating cam slot 212 when the driving device 22 rotates reversely and the sleeve 216 retreats.

With reference to FIG. 1 to FIG. 6, according to the rebar tying machine of the present invention, the winding mechanism 21 includes an inner core 213, a winding guide head 214 mounted on the inner core 213, and a lead screw 215 driving the inner core 213. The inner core 213 and the lead screw 215 are mounted within the sleeve 216, and the advance/retreat locating slot 211 and the rotating cam slot 212 are disposed on the sleeve 216. A fixing sheath 217 is mounted on the sleeve 216. A threaded block 218 connected to the sleeve 216 through the fixing sheath 217 is mounted on the lead screw 215. When in operation, the driving device 22 drives the lead screw 215 to rotate, and the lead screw 215 drives the inner core 213 to open the winding guide head 214 during the rotation. Due to the spiral structure on the lead screw 215, the threaded block 218, which is fitted with the spiral structure on the lead screw 215, is mounted on the sleeve 216 sleeved outside the lead screw 215. At this moment, the anti-rotation fixing pin 231 is located in the advance/retreat locating slot 211 on the sleeve 215, and can just take linear advance movement under the action of the lead screw 215 and the threaded block 218. The winding guide head 214 moves to the location of the steel wires and clamps them when the sleeve 216 advances. When the sleeve 216 advances to this position, the anti-rotation fixing pin 231 on the locking device 23 moves relative to the sleeve 216 back to a position where the rotating cam slot 212 is located. At this moment, the anti-rotation fixing pin 231 is unable to restrict the rotation of the sleeve 216, and this moment the threaded block also moves to a top end of the spiral structure on the lead screw. The lead screw is connected to the sleeve and the winding guide head 214 through the threaded block to rotate together, in order to twist the clamped steel wires, thereby for winding. After the rotation is finished, the driving device 22 starts to drive the lead screw 215 to rotate reversely, and the sleeve 216 retreats and rotates reversely accordingly. Due to the single direction of the rotating cam slot 212, the anti-rotation fixing pin 231 is clamped into the groove, and the rotation of the sleeve 216 is restricted only to linear retreat movement under the action of the lead screw 215. The anti-rotation fixing pin 231 enters the advance/retreat locating slot 211, the driving device 22 stops operating, and the winding mechanism 21 is fixed in a correct standby position. The process thus enters the next operating state.

Figure 2:
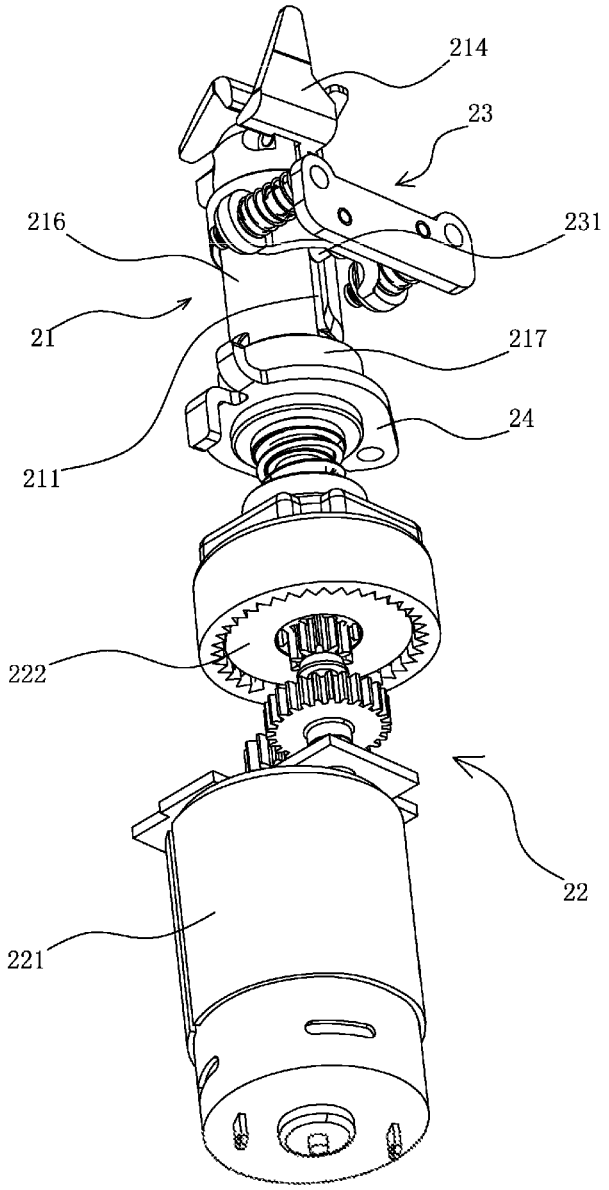
FIG. 2 is a structure diagram of a steel wire winding assembly in the rebar tying machine according to the present invention.
Figure 3:
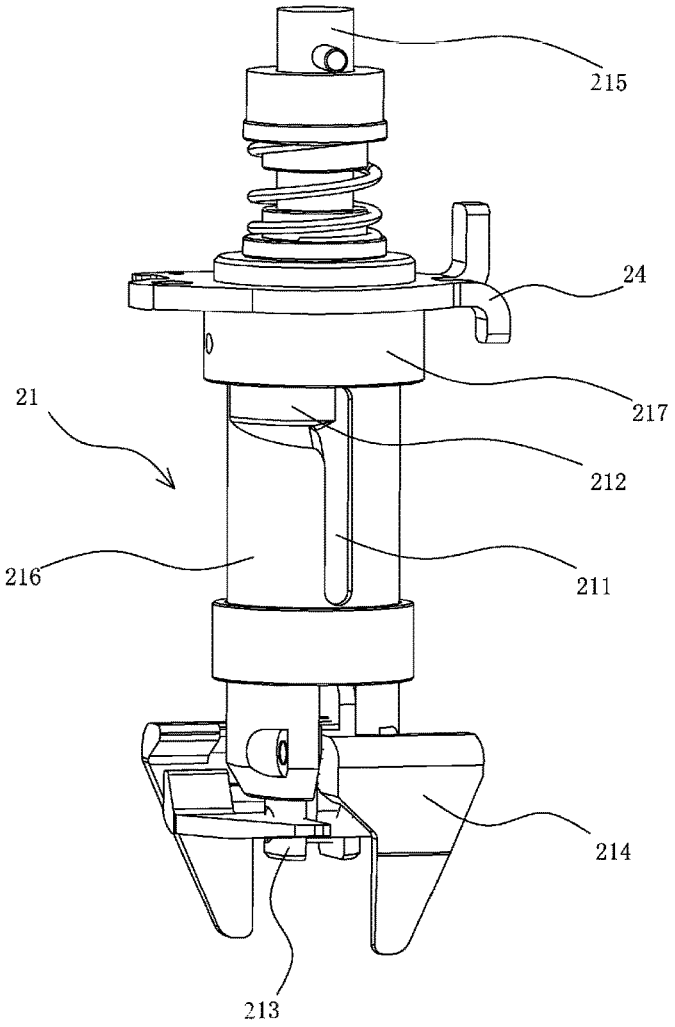
FIG. 3 is a structure diagram of a winding mechanism in the rebar tying machine according to the present invention.
Figure 4:
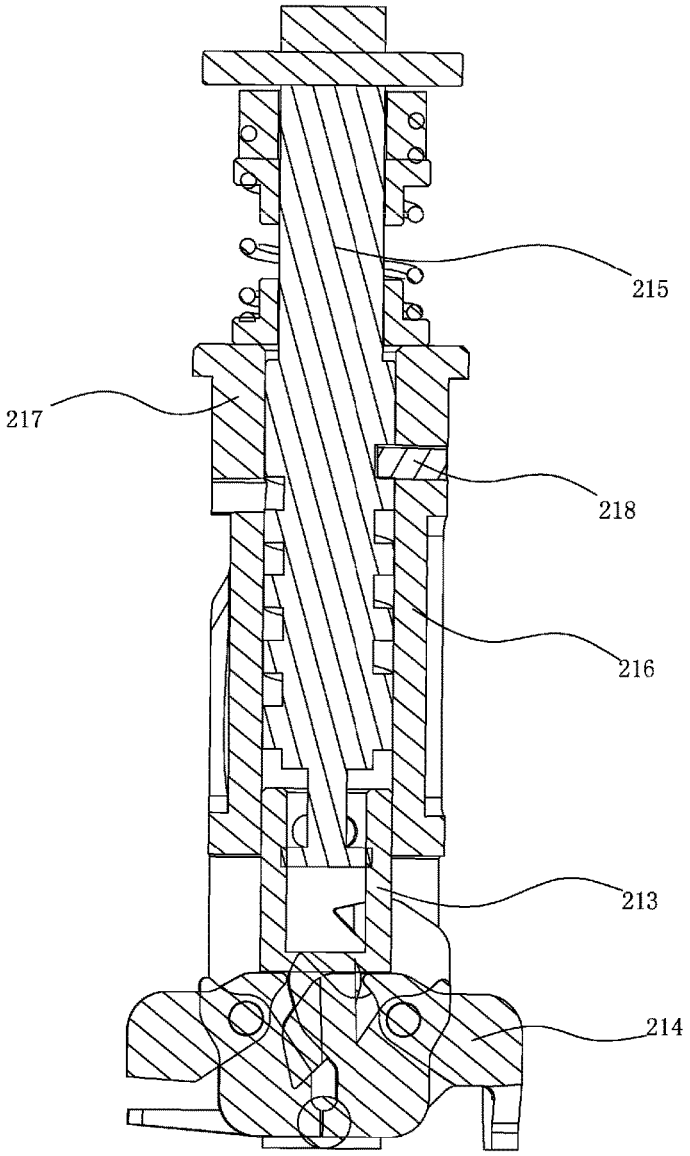
FIG. 4 is a sectional view of the winding mechanism in the rebar tying machine according to the present invention.
Figure 5:
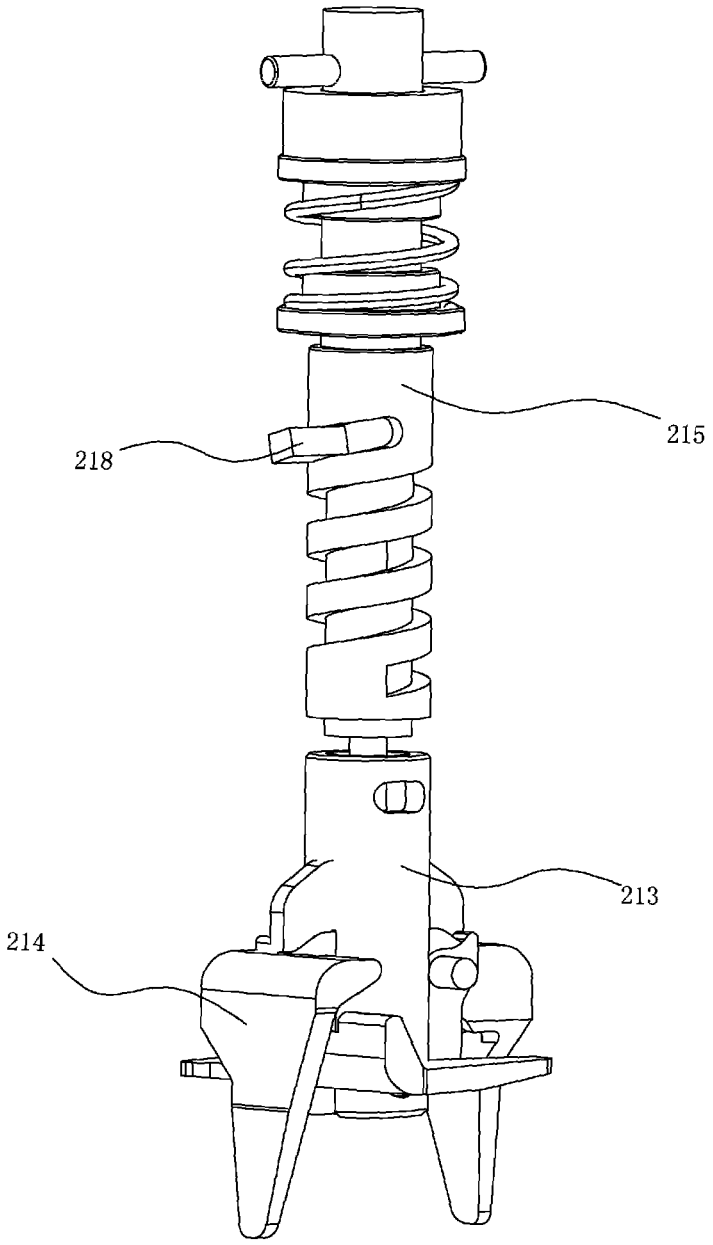
FIG. 5 is an internal structure diagram of the winding mechanism in the rebar tying machine according to the present invention.
Figure 6:
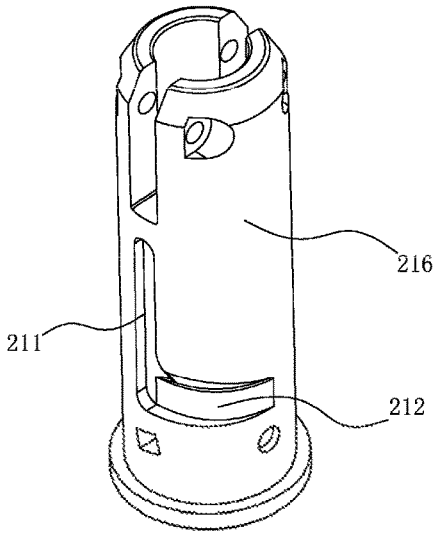
FIG. 6 is a structure diagram of a sleeve in the rebar tying machine according to the present invention.

With reference to FIG. 1 to FIG. 3, according to the rebar tying machine of the present invention, the winding mechanism 21 further includes a wire cutting plate 24 mounted on the sleeve 216 through the fixing sheath 217. The wire cutting plate 24 in the winding mechanism 21 is connected to a linear cutting-off device 33, and the wire cutting plate 24 is connected to the linear cutting-off device 33 on the tying machine main body 1. During the process of driving the winding mechanism 21 by the driving device 22 to move forward, the wire cutting plate 24 travels forward to enable the linear cutting-off device 33 to cut the steel wire off.

With reference to FIG. 2, according to the rebar tying machine of the present invention, the driving device 22 includes a drive motor 221 and a transmission gear set 222 connected to the drive motor 221, the transmission gear set 222 being connected to the lead screw 215. The drive motor 221 in the driving device 22 powers the lead screw 215 to rotate and rotate reversely, and the power output by the drive motor 221 is transferred to the lead screw 215 by the transmission gear set 222 connected to the lead screw 215. In the steel wire winding assembly 2 of the present invention, the transmission gear set 222 uses a transmission mode of a planetary gear set. However, it is not limited thereto, and other transmission modes may be used. Therefore, using as a conventional technological means in the transmission mode to realize power transmission shall be deemed as falling into the protection scope of the present invention.

In the present invention, two embodiments of the locking device are listed and described in detail as below.

Embodiment 1

Figure 7:
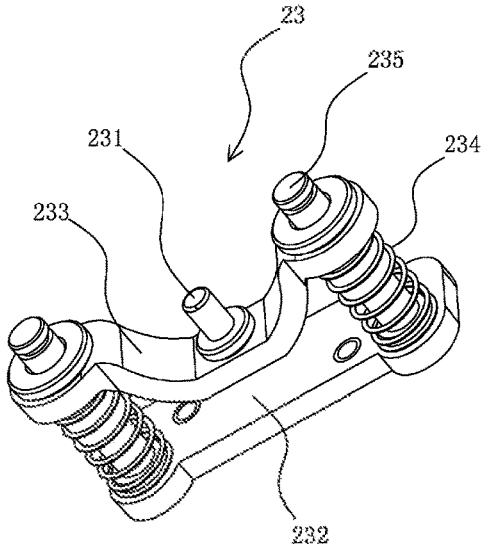
FIG. 7 is a structure diagram of Embodiment 1 of a locking device in the rebar tying machine according to the present invention.

With reference to FIG. 7, according to the rebar tying machine of the present invention, the locking device 23 further includes a fixing base 232 and a connecting plate 233 mounted on the fixing base 232. The anti-rotation fixing pin 231 is mounted on the connecting plate 233, and a fixing shaft 235 with a resetting spring 234 is disposed on the fixing base 232; and the connecting plate 233 is mounted on the fixing shaft 234. Since the advance/retreat locating slot 211 and the rotating cam slot 212, which are disposed on an outer wall of the sleeve 216, are fitted with the resetting spring 234 on the fixing shaft 235, the jamming caused by the entrance of the dirt is effectively avoided, and the service life of the machine is prolonged.

Embodiment 2

Figure 15:
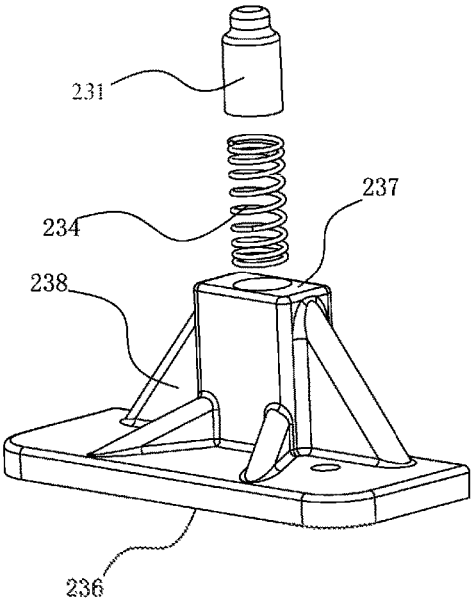
FIG. 15 is a structure diagram of Embodiment 2 of the locking device in the rebar tying machine according to the present invention.

With reference to FIG. 15, according to the rebar tying machine of the present invention, the locking device 23 further includes a pedestal 236 having thereon a hollow protrusion 237 within which the anti-rotation fixing pin 231 is disposed. A resetting spring 234 is provided between the anti-rotation fixing pin 231 and the protrusion 237; and a reinforcing rib 238 is formed between the pedestal 236 and the protrusion 237 to reinforce the connection strength. Since the advance/retreat locating slot 211 and the rotating cam slot 212 are fitted with each other by the anti-rotation fixing pin therein, when in operation, the winding assembly can automatically rotate and stop rotating in accordance with specific conditions, thereby improving the safety factor of the overall operation.

With reference to FIG. 11 to FIG. 14, according to the rebar tying machine of the present invention, the steel wire cutting-off mechanism 3 includes a transmission device 31, a wire discharging block 32 and a linear cutting-off device 33. The transmission device 31 is connected to the linear cutting-off device 33; the wire discharging block 32 has a wire discharging passage 321, and is further provided with a chute 322 intersected with the wire discharging passage 321; and a wire cutter 323 in the linear cutting-off device 33 linearly slides in the chute 322. The chute 322 intersected with the wire discharging passage 321 is disposed within the wire discharging block 32. The steel wires, entering the wire discharging passage 321 within the wire discharging block 32, are cut off by linearly feeding the wire cutter 323 of the linear cutting-off device 33 in the chute 322 driven by the driving device 22.With such linear motion mechanism, the rebar tying machine lowers the processing requirements and is easy to mount and low in production cost.

With reference to FIG. 11 to FIG. 14, according to the rebar tying machine of the present invention, the linear cutting-off device 33 includes an oscillator 331 connected to the wire cutter 323, a driving leg 332 of the oscillator 331 is connected to the transmission device 31, and a linkage leg 333 of the oscillator 331 is connected to the wire cutter 323 through a connecting sheet 334. The transmission device 31 includes a large fork 312 and a small fork 313 connected to each other through a connecting pin 311, and a lower drive plate 314 connected to the large fork 312. The small fork 313 is connected to the oscillator 331 through a connecting rod 315.

Figure 8:
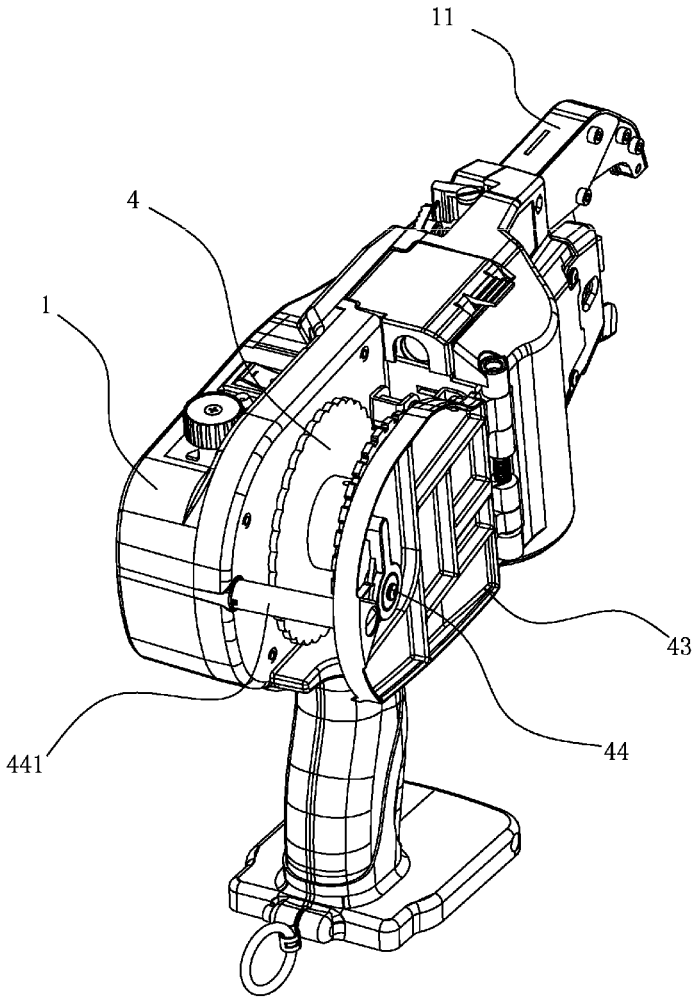
FIG. 8 is a perspective structure diagram of the rebar tying machine according to the present invention.
Figure 9:
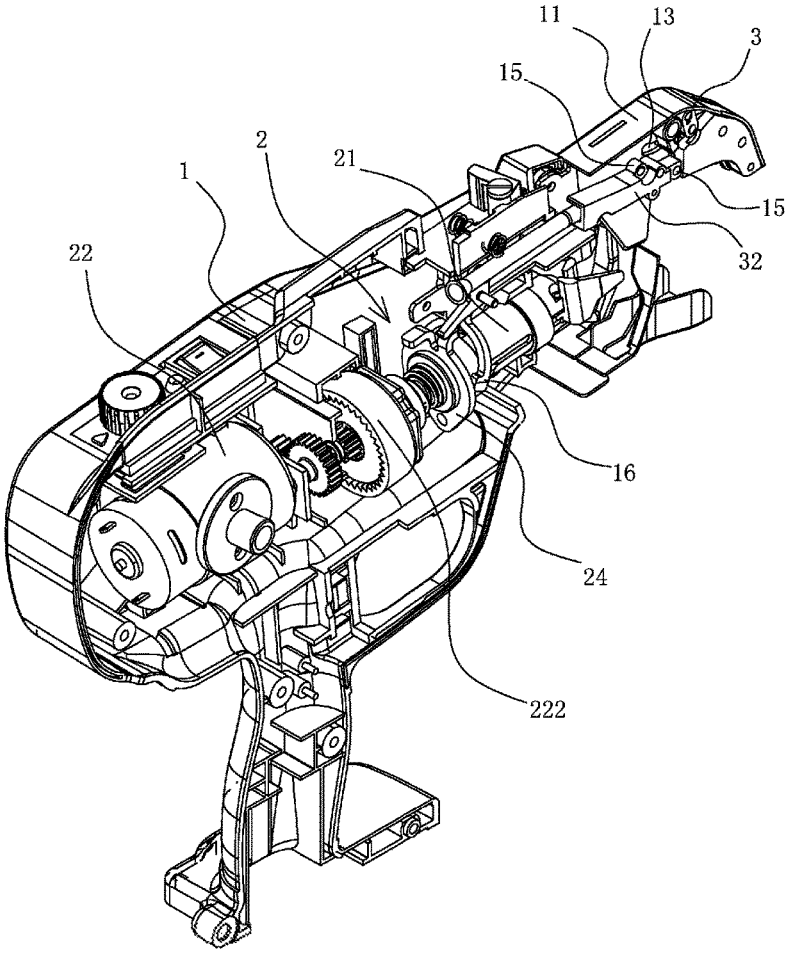
FIG. 9 is an internal structure diagram of the rebar tying machine according to the present invention from another angle of view.
Figure 10:
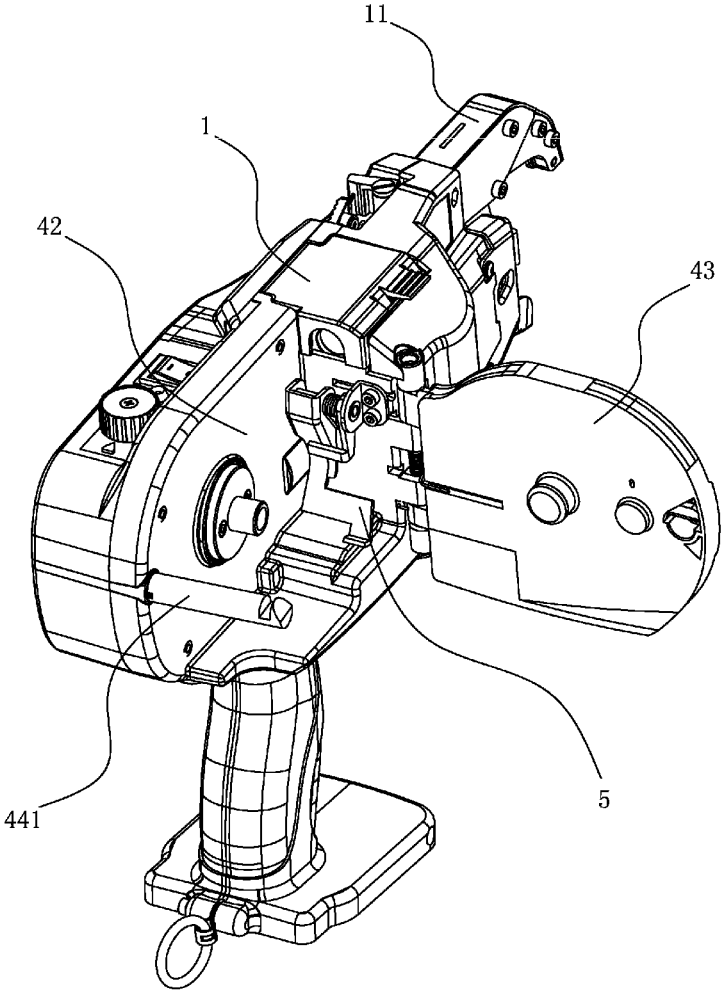
FIG. 10 is a structure diagram of the rebar tying machine according to the present invention, without a steel wire reel therein.
Figure 11:
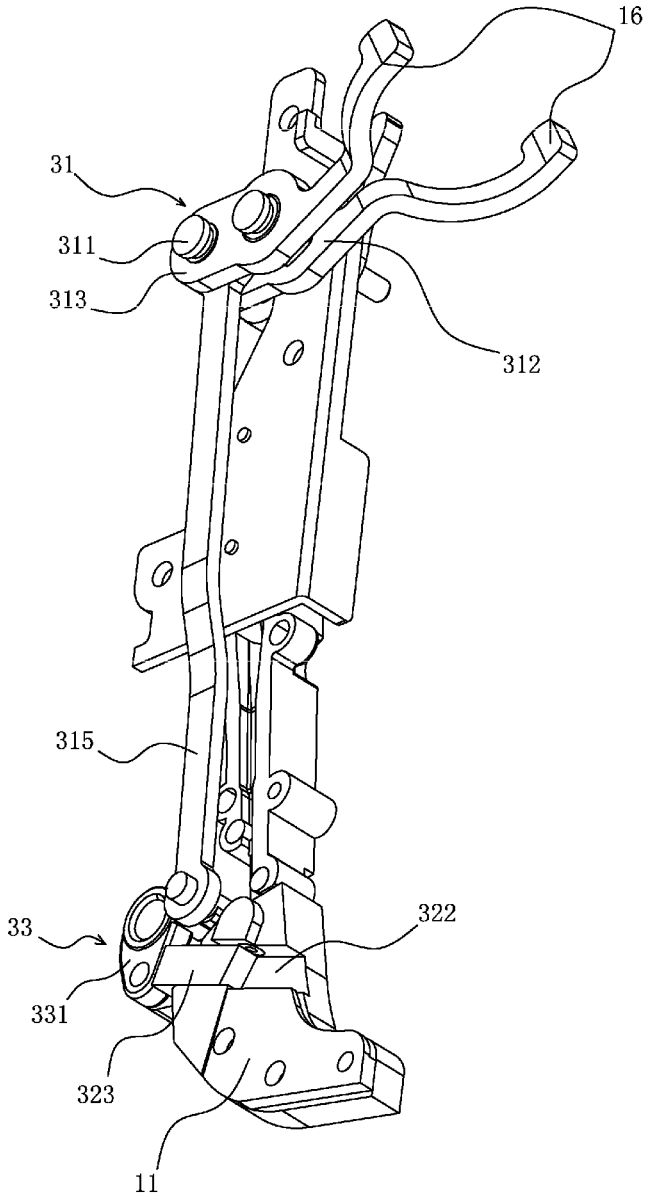
FIG. 11 is a structure diagram of a steel wire cutting-off mechanism in the rebar tying machine according to the present invention.
Figure 12:
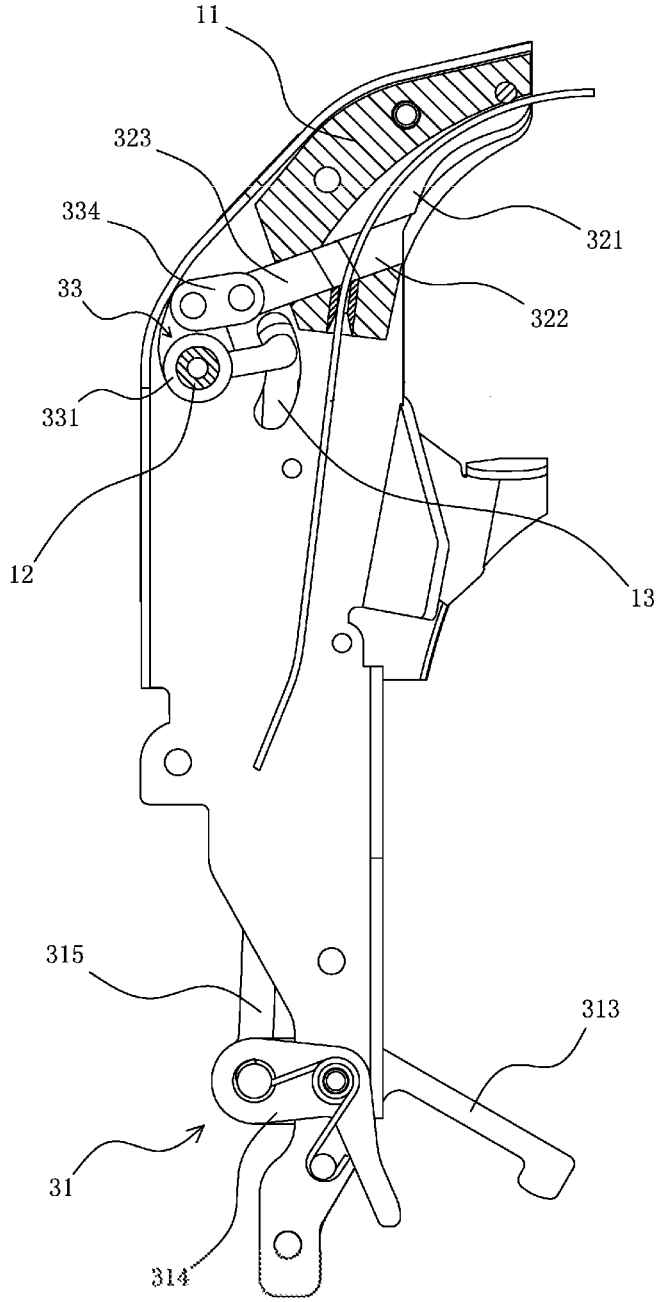
FIG. 12 is an elevation of the steel wire cutting-off mechanism in the rebar tying machine according to the present invention.
Figure 13:
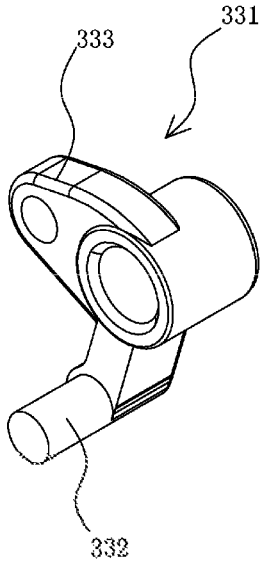
FIG. 13 is a structure diagram of an oscillator in the rebar tying machine according to the present invention.
Figure 14:
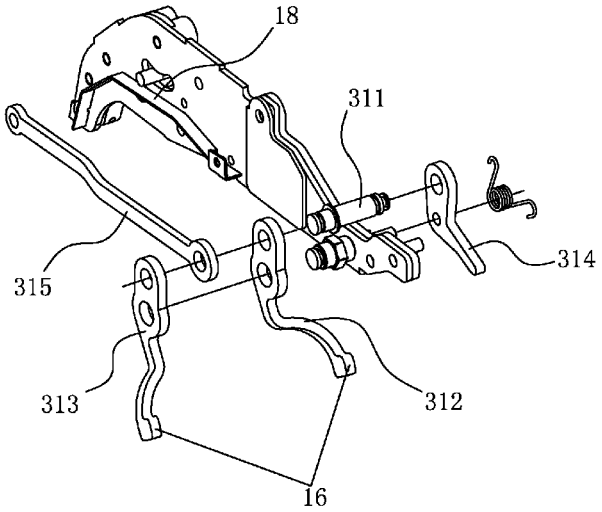
FIG. 14 is a disassembled structure diagram of the steel wire cutting-off mechanism in the rebar tying machine according to the present invention.

With reference to FIG. 8 and FIG. 14, according to the rebar tying machine of the present invention, a guide portion 11, the leading end of which bends into a circular arc, is disposed at the leading end of the main body 1, the oscillator 331 is rotationally mounted on the guide portion 11 through a bushing 12, and the wire discharging block 32 is mounted at the leading end of the guide portion 11. A waist-shaped hole 13 is formed on the guide portion 11, and the driving leg 333 can slide in the waist-shaped hole 13 to be connected to the connecting rod 315. A wire guide block 14 is disposed on the guide portion 11, and a wire guide post 15 by which the steel wires are led into the wire discharging block 32 is disposed on the wire guide block 14. The large fork 312 and the small fork 313 are rotationally mounted on the guide portion 11, with triggers 16 being disposed on the large fork 312 and the small fork 313 and supported against the wire cutting plate 24.

Figure 16:
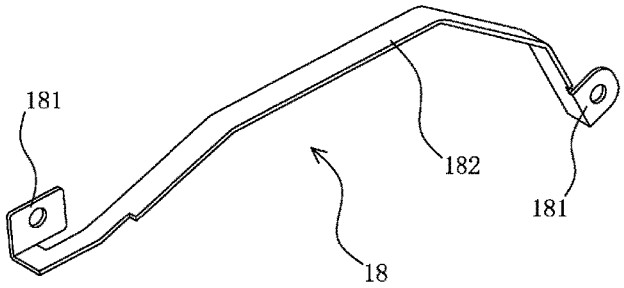
FIG. 16 is a structure diagram of an elastic wire guide piece in the rebar tying machine according to the present invention.
Figure 17:
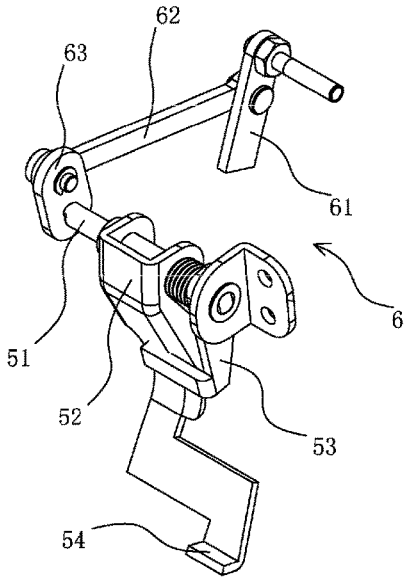
FIG. 17 is a structure diagram of a wire wheel brake mechanism in the rebar tying machine according to the present invention.
Figure 18:
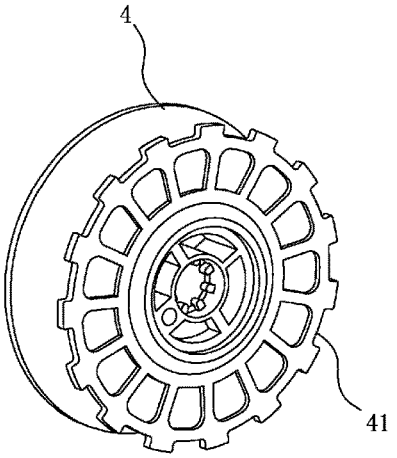
FIG. 18 is a structure diagram of a steel wire reel in the rebar tying machine according to the present invention.

With reference to FIG. 8 and FIG. 16, according to the rebar tying machine of the present invention, an elastic wire guide piece 18 is mounted in the wire discharging passage 321 of the guide portion 11, both two ends of the elastic wire guide piece 18 are bent to form a fixing piece 181 by which the elastic wire guide piece 18 is mounted on the guide portion 11, and a downward-bent leading portion 182 fitted with the wire discharging passage 321 is formed on the elastic wire guide piece 18.

With reference to FIG. 8 to FIG. 10, FIG. 17 and FIG. 18, according to the rebar tying machine of the present invention, a steel wire reel 4 and a wire wheel brake mechanism 5 for restricting the rotation of the steel wire reel 4 can be rotationally mounted on the main body 1. A power transmission device 6 for driving the wire wheel brake mechanism 5 is mounted on the guide portion 11, and connected to the wire cutting plate 24; the power transmission device 6 includes a brake plate 61 and a linkage plate 63 connected to the brake plate 61 through a lower connecting rod 62, the linkage plate 63 being connected to the wire wheel brake mechanism 5, the brake plate 61 being resisted against the wire cutting plate 24. The wire wheel brake mechanism 5 includes a brake shaft 51, as well as a brake piece 52 and a brake rocker arm 53 which are both rotationally mounted on the brake shaft 51, the brake piece 52 being connected to the steel wire reel 4. Locking grooves 41 are evenly disposed on the steel wire reel 4; and a bent brake block 54 is formed on the brake piece 52 and clamped within the locking grooves 41.

With reference to FIG. 8 to FIG. 21, according to the rebar tying machine of the present invention, an accommodating cavity 42 for accommodating the steel wire reel 4 is disposed on the main body 1; and a cover plate 43 is rotationally mounted at the accommodating cavity 42 on the main body 1. A rotating lock device 44 is mounted on the cover plate 43, and the steel wire reel 4 is mounted within the accommodating cavity 42 by the cover plate 43 through the rotating lock device 44. Since the rotating lock device 44 is mounted on the tying machine main body 1, not only the steel wire reel 4 may be mounted on the main body 1, but also the cover plate 43 mounted on the tying machine main body 1 may be completely opened, without interfering the mounting and demounting of the steel wire reel 4 so that the steel wire reel 4 may be demounted and mounted conveniently.

With reference to FIG. 8 to FIG. 21, according to the rebar tying machine of the present invention, the rotating lock device 44 includes a cover plate chuck 441 mounted on the main body 1, and a rotary knob 442 rotationally mounted on the cover plate 43, the rotary knob 442 being clamped on the cover plate chuck 441. After the steel wire reel 4 is mounted, the cover plate 43 is forced in a closed direction, and when the rotary knob 442 mounted on the cover plate 43 is turned to have a click sound, it is indicated that the rotary knob 442 has been clamped into the cover plate chuck 441. Therefore, the cover plate 43 has been in a locked state. With such a structure, a user may close the cover plate 43 without turning the rotary knob 442, so that some action may be omitted during the operation. When a force is applied to an upper end portion of the rotary knob 442, the rotary knob 442 may rotate around a rotary knob securing shaft 448 for rotationally mounting the rotary knob 442. The cover plate 43 is automatically opened under the action of a cover plate torsion spring on a hinge shaft between the cover plate 43 and the main body 1.

Figure 19:
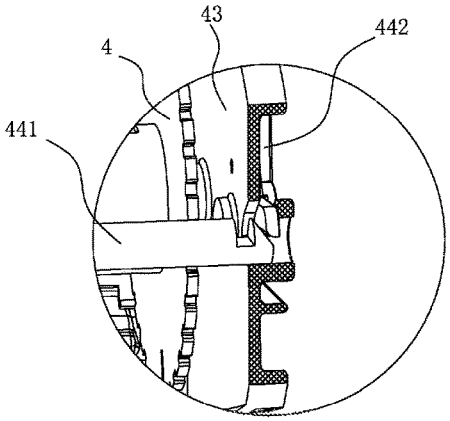
FIG. 19 is a sectional view of a rotating lock device in the rebar tying machine according to the present invention.
Figure 20:
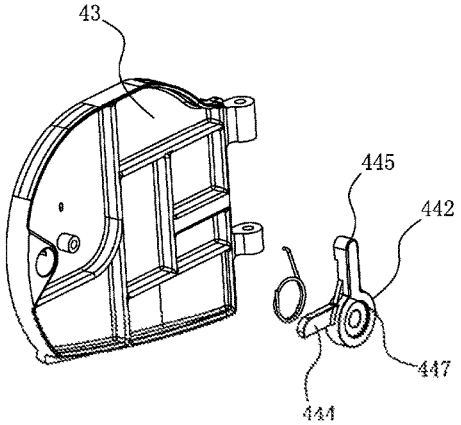
FIG. 20 is a structure diagram of a cover plate of the rebar tying machine according to the present invention.
Figure 21:
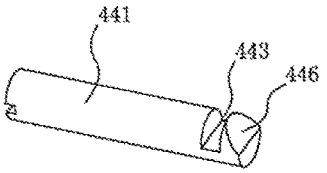
FIG. 21 is a structure diagram of a cover plate chuck in the rebar tying machine according to the present invention.

With reference to FIG. 19 to FIG. 21, according to the rebar tying machine of the present invention, a clamping slot 443 is formed on the cover plate chuck 441. A clamp leg 444 and a push bar 445 are disposed on the rotary knob 442. The steel wire reel 4 is mounted within the accommodating cavity 42 by clamping the clamp leg 444 into the clamping slot 443; and a transition bevel 446 is formed at the leading end of the cover plate chuck 441. The clamp leg 444 is clamped into the clamping slot 443 through the transition bevel 446, and the push bar 445 is connected to the clamp leg 444 through a connecting block 447. When the cover plate 43 is closed, the clamp leg 444 on the rotary knob 442 is properly clamped in the clamping slot 443. Therefore, the cover plate 43 is in a locked state. A bevel, which is properly fitted with the transition bevel 446 on the cover plate chuck 441, is also formed on the clamp leg 444 of the rotary knob 442. Under the action of the corresponding bevels of the cover plate chuck 441 and the rotary knob 442, the rotary knob 442 may rotate against the acting force of the torsion spring, thereby continuously applying a force to the cover plate 43 without turning the rotary knob 442. After the cover plate is closed to a position on the cover plate chuck 441 where the clamping slot 443 is located, the rotary knob 442 is automatically clamped into the clamping slot 443 under the action of the torsion spring, thereby locking the cover plate 43.

What is claimed is:

1. A rebar tying machine comprising a tying machine main body and a steel wire winding assembly mounted within the main body, characterized in that the steel wire winding assembly comprises:

a winding mechanism, which comprises an inner core, a winding guide head mounted on the inner core and a lead screw for driving the inner core, the inner core and the lead screw are mounted within a sleeve; and a driving device for driving the winding mechanism, which comprises a drive motor and a transmission gear set connected to the drive motor; the transmission gear set is connected to the lead screw; and a locking device for locking the winding mechanism, which comprises a pedestal having thereon a hollow protrusion in which an anti-rotation fixing pin is disposed, a resetting spring is provided between the anti-rotation fixing pin and the protrusion; and a reinforcing rib is formed between the pedestal and the protrusion;

an advance/retreat locating slot and a rotating cam slot, which are disposed on the winding mechanism; the advance/retreat locating slot is axially disposed along the winding mechanism; and the rotating cam slot is gradually shallower in a peripheral direction of the winding mechanism and is disposed along a periphery of the winding mechanism, and an axial extension of a side wall of the rotating cam slot along the sleeve forms a chamfer structure; the anti-rotation fixing pin of the locking device axially moves in the advance/retreat locating slot relative to the winding mechanism, and slides in the rotating cam slot relative to the winding mechanism; and a steel wire cutting-off mechanism, to which a wire cutting plate in the steel wire winding assembly is connected, is further mounted within the main body; wherein the steel wire cutting-off mechanism comprises a transmission device, a wire discharging block and a linear cutting-off device.

2. The rebar tying machine according to claim 1, characterized in that the advance/retreat locating slot and the rotating cam slot are disposed on the sleeve, and a fixing sheath is disposed on the sleeve; a threaded block connected to the sleeve through the fixing sheath is mounted on the lead screw;

and the wire cutting plate is mounted on the sleeve through the fixing sheath.

3. The rebar tying machine according to claim 1, characterized in that the transmission device is connected to the linear cutting-off device;

the wire discharging block has a wire discharging passage, and is further provided with a chute intersected with the wire discharging passage;

and a wire cutter in the linear cutting-off device linearly slides in the chute.

4. The rebar tying machine according to claim 3, characterized in that the linear cutting-off device comprises an oscillator connected to the wire cutter, a driving leg of the oscillator is connected to the transmission device, a linkage leg of the oscillator is connected to the wire cutter through a connecting sheet;

the transmission device comprises a large fork and a small fork connected to each other through a connecting pin, and a lower drive plate connected to the large fork;

and the small fork is connected to the oscillator through a connecting rod.

5. The rebar tying machine according to claim 4, characterized in that a guide portion, a leading end of which bends into a circular arc, is disposed at a leading end of the main body;

the oscillator is rotationally mounted on the guide portion through a bushing, and the wire discharging block is mounted at the leading end of the guide portion; and a hole is formed on the guide portion, and the driving leg can slide in the hole to be connected to the connecting rod; and the large fork and the small fork are rotationally mounted on the guide portion.

6. The rebar tying machine according to claim 5, characterized in that an elastic wire guide piece is mounted within a wire discharging passage of the guide portion, two ends of the elastic wire guide piece are bent to form a fixing piece by which the elastic wire guide piece is mounted on the guide portion, and a downward-bent leading portion fitted with the wire discharging passage is formed on the elastic wire guide piece.

7. The rebar tying machine according to claim 5, characterized in that a steel wire reel and a wire wheel brake mechanism for restricting a rotation of the steel wire reel can be rotationally mounted on the main body;

a power transmission device for driving the wire wheel brake mechanism is mounted on the guide portion, and connected to the wire cutting plate; the power transmission device comprises a brake plate and a linkage plate connected to the brake plate through a lower connecting rod, the linkage plate being connected to the wire wheel brake mechanism, the brake plate being resisted by the wire cutting plate;

the wire wheel brake mechanism comprises a brake shaft, a brake piece and a brake rocker arm which are both rotationally mounted on the brake shaft, the brake piece being connected to the steel wire reel;

locking grooves are evenly disposed on the steel wire reel; and a bent brake block is formed on the brake piece and clamped within the locking grooves.

8. The rebar tying machine according to claim 7, characterized in that an accommodating cavity for accommodating the steel wire reel is disposed on the tying machine main body; and a cover plate is rotationally mounted at a position on the tying machine main body where the accommodating cavity is located, a rotating lock device is mounted on the cover plate, and the steel wire reel is mounted within the accommodating cavity by the cover plate through the rotating lock device.

9. The rebar tying machine according to claim 8, characterized in that the rotating lock device comprises a cover plate chuck mounted on the main body, and a rotary knob rotationally mounted on the cover plate;

wherein the rotary knob is clamped on the cover plate chuck, and a clamping slot is formed on the cover plate chuck; a clamp leg and a push bar are disposed on the rotary knob;

the steel wire reel is mounted within the accommodating cavity by clamping the clamp leg into the clamping slot; and a transition bevel is formed at a leading end of the cover plate chuck, the clamp leg is clamped into the clamping slot through the transition bevel, and the push bar is connected to the clamp leg through a connecting block.

* * * * *